US006726021B2

(12) United States Patent
Kennedy et al.

(10) Patent No.: US 6,726,021 B2
(45) Date of Patent: Apr. 27, 2004

(54) STOPPER DEBRIS SEPARATOR

(75) Inventors: Patrick G. Kennedy, Penn Laird, VA (US); Keith B. Coffman, Fulks Run, VA (US)

(73) Assignee: Merck & Co., Inc., Rahway, NJ (US)

( * ) Notice: Subject to any disclaimer, the term of this patent is extended or adjusted under 35 U.S.C. 154(b) by 154 days.

(21) Appl. No.: 10/085,770

(22) Filed: Feb. 28, 2002

(65) Prior Publication Data

US 2003/0173261 A1 Sep. 18, 2003

(51) Int. Cl.[7] ..... B07B 4/02; B07B 71/01

(52) U.S. Cl. ..... 209/139.1; 209/149; 209/154; 209/722

(58) Field of Search ..... 209/139.1, 149, 209/154, 722, 138, 141, 139.2, 137; 15/3.16, 300.1, 309.2, 354

(56) References Cited

U.S. PATENT DOCUMENTS

| | | | | | |
|---|---|---|---|---|---|
| 1,491,443 | A | * | 4/1924 | Stebbins | 209/138 |
| 1,835,511 | A | * | 12/1931 | Means | 34/280 |
| 1,850,756 | A | * | 3/1932 | Lessing | 209/137 |
| 1,888,372 | A | * | 11/1932 | Bramwell | 209/139.1 |
| 2,754,966 | A | * | 7/1956 | Rollgaard et al. | 209/139.1 |
| 2,795,329 | A | * | 6/1957 | Schaub | 209/139.1 |
| 3,862,688 | A | * | 1/1975 | Terhorst | 209/139.1 |
| 4,159,941 | A | * | 7/1979 | Avery, Jr. | 209/3 |
| 4,599,163 | A | * | 7/1986 | Manola | 209/139.2 |
| 4,857,173 | A | * | 8/1989 | Belk | 209/2 |
| 5,106,488 | A | * | 4/1992 | Jonasson | 209/17 |
| 5,279,466 | A | * | 1/1994 | Williams | 241/52 |
| 6,216,876 | B1 | * | 4/2001 | Quillian, III | 209/138 |
| 6,283,300 | B1 | * | 9/2001 | Bielagus et al. | 209/29 |
| 6,391,095 | B1 | * | 5/2002 | Conrad et al. | 95/271 |
| 6,524,358 | B2 | * | 2/2003 | Yang | 55/337 |
| 2003/0085158 | A1 | * | 5/2003 | Oirschot | 209/139.1 |

FOREIGN PATENT DOCUMENTS

| | | | | |
|---|---|---|---|---|
| DE | 3540682 | * | 5/1987 | |
| FR | 2680246 | * | 2/1993 | G01N/19/00 |

* cited by examiner

*Primary Examiner*—Donald P. Walsh
*Assistant Examiner*—Daniel K Schlak
(74) *Attorney, Agent, or Firm*—Mark R. Daniel; Matthew A. Leff

(57) ABSTRACT

A stopper debris separator useful for removing unwanted debris from stoppers utilized to seal bottles of IV pharmaceutical compositions at the manufacturing process. Debris-containing stopper in the stopper injection hopper are drawn through the stopper duct into the cyclone separator tube by the vacuum wherein the debris on the stoppers is separated therefrom and drawn through the vacuum duct into the vacuum filter.

22 Claims, 2 Drawing Sheets

STOPPER DEBRIS SEPARATOR

FIELD OF THE INVENTION

The present invention is directed to an apparatus for separating unwanted debris from stoppers utilizing a novel vacuum separator system.

BACKGROUND OF THE INVENTION

During the process of manufacturing and packaging pharmaceutical compositions, particularly of a powder form, measured amounts of the compositions may be placed into sterilized bottles, followed by sealing the bottles with sterilized rubber stoppers, and placing tamper-evident labels over the stoppers.

The packaging components, i.e. bottles and stoppers, must be washed and sterilized prior to entering the process. Typically, the rubber stoppers are purchased new from intravenous (IV) stopper manufactures. While the manufacturers may represent the stoppers to be free of unwanted material and debris, it has been found that lint, hairs, fibers, etc. may be associated therewith. After bottle sealing and upon final inspection, if debris is found in packaged products, the bottles are rejected and the product is destroyed. Debris contained within sterilized, pharmaceutical products typically result in the loss of products and revenue.

To ensure that IV stopper are free of debris, a novel stopper vacuuming step may be introduced into stopper preparation process. Prior to washing and sterilizing the stoppers, they may be placed into a debris separator to ensure that any unwanted, extraneous material is removed prior to the washing step.

It has now been discovered that vacuuming the stoppers prior to utilizing them in the packaging process is beneficial to remove all unwanted matter and debris therefrom. To accomplish this feat, a novel stopper debris separator is described herein.

SUMMARY OF THE INVENTION

The present invention is directed to an apparatus for separating dirt and unwanted debris from stoppers, particularly IV stoppers. While other uses of the apparatus of the present invention will become apparent to those skilled in the art, the present invention is more particularly directed to an apparatus for removing fine particles of unwanted debris from surfaces and voids of rubbery-type stoppers.

The stopper debris separator of the present invention, generally, may be characterized by:

a) a stopper injection hopper of suitable volume for receiving a plurality of debris-containing stoppers;

b) a stopper inlet duct having first and second ends, the first end for receiving stoppers from the stopper injection hopper;

c) a vertically-positioned, cyclone separator tube having first and second ends, and a stopper receiving duct positioned proximate and adjacent to the first end of the cyclone separator, the second end of the stopper inlet duct connected to the stopper receiving duct, the cyclone separator tube being of sufficient diameter for receiving stoppers from the inlet duct;

d) a stopper receiving vessel, positioned beneath and connected to the first end of the cyclone separator tube, the vessel being of sufficient capacity to receive a plurality of stoppers from the separator tube;

e) an air bleeding valve located on the receiving vessel, the valve being suitable for adjusting the vacuum pressure on the separator;

f) a vacuum pump having an inlet and outlet for transferring air, a filter for collecting debris, and a vacuum inlet;

g) a vacuum duct having first and second ends, the first end connected to the second end of the cyclone separator tube, and the second end connected to the vacuum inlet of the vacuum pump; and h) means for transferring air through the inlet and outlet of the vacuum pump to create a vacuum within the separator, wherein, debris-containing stoppers in the stopper injection hopper are drawn through the stopper duct into the cyclone separator tube by the vacuum, wherein the debris on the stoppers is separated therefrom and drawn through the vacuum duct into the vacuum filter to produce clean stoppers, and wherein the clean stoppers drop into the stopper receiving vessel.

DETAILED DESCRIPTION OF THE INVENTION

Figure 1:
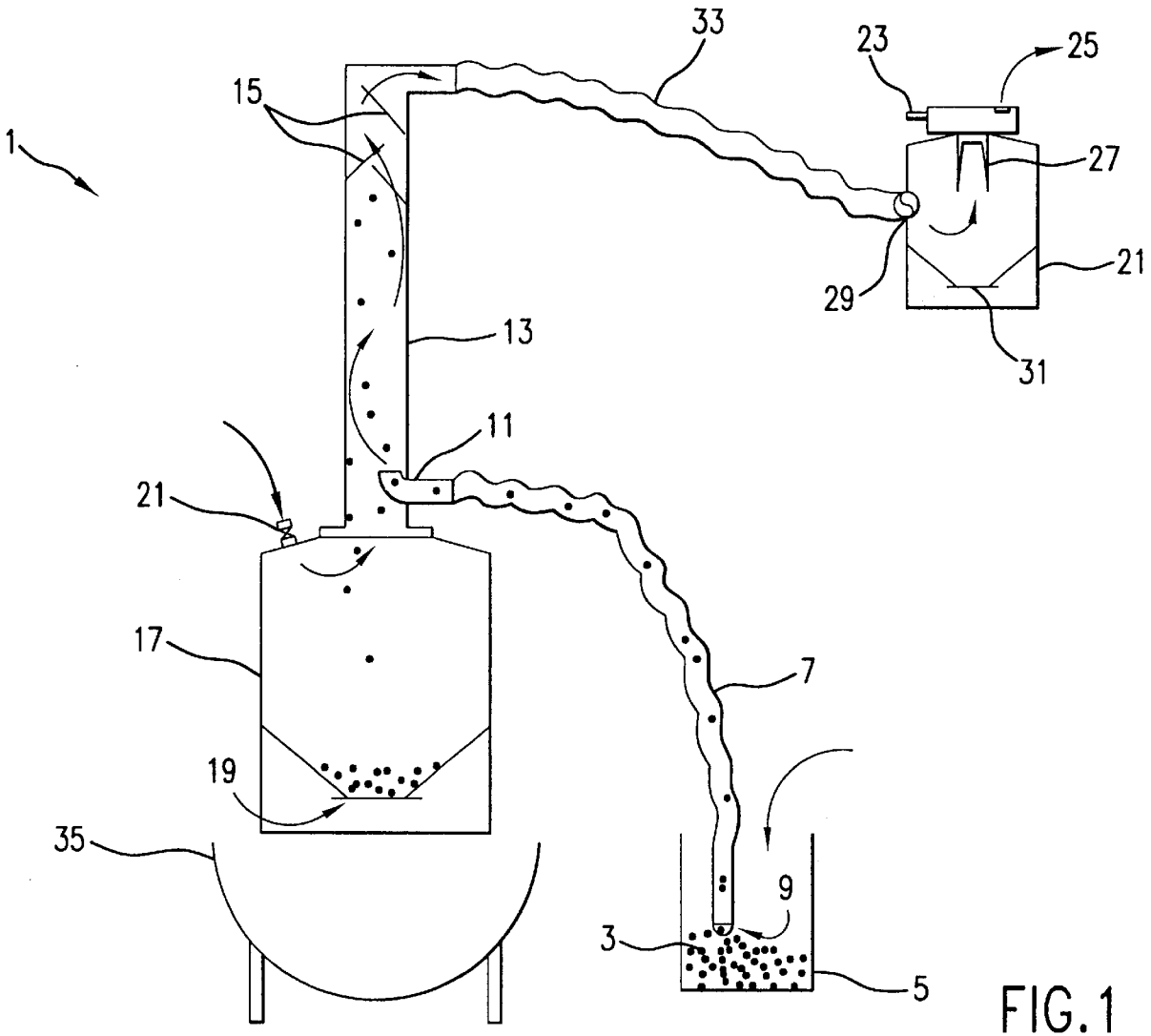
FIG. 1 is a side view in elevation of one embodiment of the debris separator of the present invention.

In accordance with the general features of the invention, FIG. 1 illustrates one embodiment of the invention, stopper debris separator (1) operated by a vacuum system. Rubbery-type stoppers (3) are placed into stopper injection hopper (5). Stopper inlet duct (7) is inserted into stopper injection hopper (5) to contact stoppers (3); nozzle (9) is located on a first end of stopper inlet duct (7). Nozzle (9) is designed to ensure that one stopper, at a time, is received into the apparatus via stopper inlet duct (7). The second end of stopper inlet duct (7) is connected to stopper director (11), which is incorporated into cyclone separator tube (13). Stopper director (11) is positioned in the lower end and separator fingers (15) are positioned in the upper end of vertically-positioned, cyclone separator tube (13). As used herein, the term "vertically-positioned" is defined as the placement of the cyclone separator tube (13), as well as the components attached thereto, in a position so that stoppers within the tube will fall, by the forces of gravity, from the cyclone separator tube to a receiver vessel defined herein after. Therefore, the tube may be at any vertical-angle ensure that the stoppers will fall to the receiver vessel. The lower end of cyclone separator tube (13) is connected to receiver vessel (17). The lower end of receiver vessel (17) is equipped with funnel (19) having an openable door attached thereto, and air bleed valve (21) is incorporated into the vessel. Vacuum pump (21), having air inlet (23), air outlet (25), and filter (27), is connected at vacuum inlet (29) via vacuum duct (33) to the upper end of cyclone separator tube (13). Vacuum pump (21) incorporates debris filter (27) and debris collector funnel (31) having an openable door attached thereto. Stopper collection hopper (35) may be placed under funnel (19) to collect stoppers (3).

Generally, the stoppers utilized in the process and apparatus of the invention are new from the manufacturer and may be of general nature and size as will become obvious to those skilled in the art. The stoppers retaining the highest degree of debris content are typically prepared from natural rubbers and butadienestyrene copolymers, and may vary in size and weight. These stoppers will generally exhibit a sticky surface suitable for particles to adhere thereto.

The stopper injection hopper may be equipped with a lid and is of suitable volume for receiving and holding from about 2,000 to about 10,000 stoppers. The stopper inlet duct is generally a flexible tube fabricated from polypropylene, polyethylene, polyvinylchloride, polyacetal, or the like and is of sufficient length to connect the stopper injection hopper and cyclone separator, but not of excessive length to increase the vacuum pressure necessary to pull the stoppers into the apparatus. The diameter of the stopper duct, generally at least about 2 inches, while being sufficiently large to handle a multiple influx of stoppers, is not so large as to increase the vacuum pressure necessary to operate the apparatus.

Figure 2C:
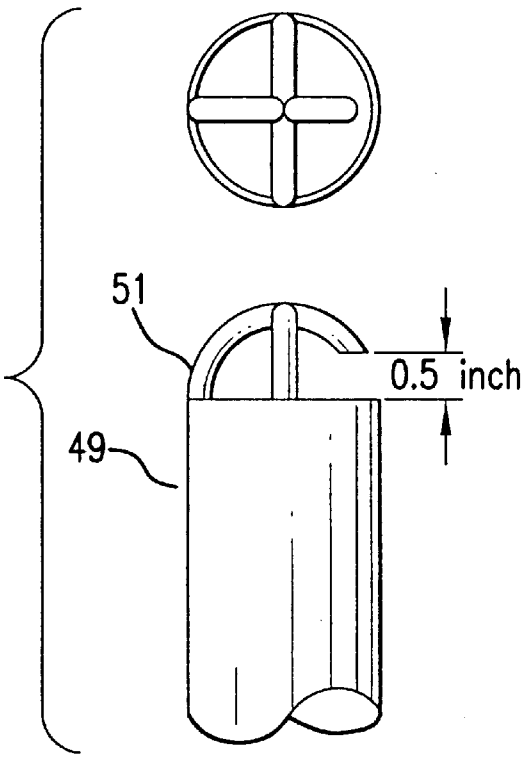
FIG. 2 is side and top views in elevation of 3-different nozzles that may be interchangeably attached to the stopper duct inlet of the debris separator.
Figure 2B:
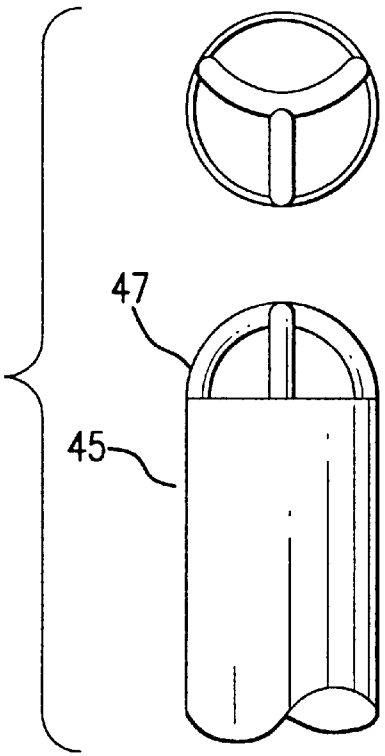
Figure 2A:
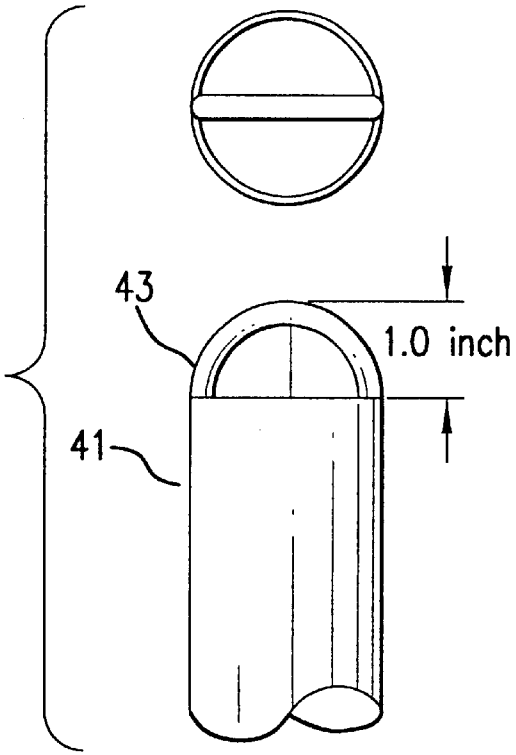

FIG. 2 illustrates several nozzles that may be utilized, by interchangeable attachment to the first end of the inlet stopper duct, to ensure that only one stopper at a time enters the inlet stopper duct; multiple entrance of stoppers at any one time may block the duct. FIG. 2*a* illustrates ADD-Vantage® nozzle (41) design utilized with the ADD-Vantage® stopper manufactured by West Pharmaceutical Services, Lionville, Pa. This stopper exhibits a height of about 0.455 inches and a diameter of about 0.625 inches. The nozzle may be characterized by a cylindrical tube of at least about 2 inches in diameter and from about 6 to about 8 inches in length so that it fits snuggly within the stopper inlet hose. One end of the nozzle is characterized by an arched-like bar (43) connected across the diameter of the tube, wherein the arch will extend to a length of about 1 inch from the end of the tube. The arch-like bar prevents the entrance of more than one Add-Vantage stopper at a time into the tube. Spacing the entrance of the stoppers into the apparatus prevents clogging of the tube as well as allows adequate individual stopper retention time in the apparatus to remove fine debris (lint, hair, etc.) from the stopper. FIG. 2*b* illustrates Trade nozzle (45) design utilized with the typical trade stopper (smaller in size than the Add-Vantage stopper). The typical trade stopper will exhibit dimensions of about 0.357 inches in length and about 0.750 inches in diameter. This nozzle is characterized by arched-like bar (47) exhibiting a triangle-shaped combination of bars intersecting at the center of the tube (see top view), wherein the arch will extend a length of about 1 inch from the tube. The nozzle will typically exhibit a diameter and length similar to the nozzle of FIG. 2*a* and may be interchanged therewith. FIG. 2*c* illustrates Monovial nozzle (49), suitable for use with Monovial® stopper, exhibiting a typical height of about 0.321 inches and a diameter of about 0.539 inches, manufactured by West Pharmaceutical services, Lionville, Pa. Again the tube length and diameter will be similar to that of the other nozzles (43, 47). However, the arched-like portion of the nozzle (51) extends about 1.0 inch away from the tube, and conforms to a perpendicular bars intersecting at the center of the tube's diameter. There is 0.5 inch section, between the end of the tube and the arched section that is removed to allow for passage of the stoppers into the stopper duct.

The cyclone separator tube is characterized as being positioned perpendicular to the ground when the apparatus is in operation. As will become apparent to those skilled in the art, the tube is sufficient length and diameter to allow the entrance and retention of a plurality of stoppers so that unwanted material may be removed therefrom by the vacuum pressure. During vacuuming the vacuum pressure is adjusted to draw the debris up through the cyclone separator tube, while stoppers are dropped (by gravitational force) to the bottom of the separator. At the lower end of the cyclone separator tube, adjacent and proximately close thereto, is located the stopper director component. The stopper director is connected to the loose end of the stopper inlet tube and serves the function of directing stoppers up into the cyclone separator tube. The upward directional flow of the stoppers allows the vacuum force to pull and swirl the stoppers up in the tube so that fine debris is removed therefrom. In the upper ¼ section of the cyclone tube separator is incorporated a plurality of separator fingers attached to the interior walls of the separator and projecting towards the center thereof. Generally, the separator fingers are arranged to prevent stoppers from entering the vacuum duct and pump. The separator fingers may be projected into the cyclone separator tube at many angle and length to prevent stoppers from being drawn into the vacuum duct by the vacuum pressure.

The receiver vessel is connected to the lower end of the cyclone separator tube and may be characterized as a closed vessel having a volume of at least about twice that of the stopper injection hopper. The lower end of the vessel may conform to a funnel shape having an openable door for releasing stoppers. An adjustable, air bleed valve is attached to the receiver vessel at a point below the stopper inlet duct. The valve may be a butterfly valve having a filter associated therewith to remove lint, dust, and the like prior to air entering the apparatus. The positioning of the air bleed valve below the stopper inlet duct provides an additional source of vacuum pressure to aid in the removal of debris from the stoppers. The valve also provides an additional means for adjusting the vacuum pressure in the apparatus.

The vacuum pump is connected at the vacuum inlet to the upper end of the vertically-positioned cyclone separator tube by the vacuum duct. The vacuum duct is generally a flexible tube fabricated from polypropylene, polyethylene, polyvinyl-chloride, polyacetal, or the like, and is of sufficient length to connect the cyclone separator tube and vacuum pump. The vacuum pump may be characterized as a closed vessel incorporating a venture-type meter having instrument air inlet and outlet, and a debris collection filter to prevent debris collected therein from escaping to the atmosphere. The lower portion of the closed vessel may incorporate a funnel-shaped bottom having an openable door for removal of the collected debris.

The stopper collection hopper may be characterized as a vessel of sufficient capacity to accept and hold up to about 10,000 stoppers. Debris-free stoppers collected in the stopper receiving vessel are held there until the door within the lower portion of the vessel is opened to release the stoppers. Optionally the stopper collection hopper may be equipped with a mechanism to wash the stoppers prior to sterilization thereof.

Generally, the units of the apparatus, i.e. stopper injection and collection hoppers, cyclone separator tube, stopper receiving vessel, and vacuum pump, may be fabricated from about 16 to about 20 gauge stainless steel or other suitable materials as will become apparent to those skilled in the art. The stoppers may incorporate holes and void therein, or they may have solid surfaces. Stainless steel components are generally suitable for pharmaceutical manufacturing, packaging (pre- and post-sterilization processes).

In another embodiment of the invention, there is described a stopper debris separator, characterized by:

a) a stopper injection hopper of suitable volume for receiving a plurality of debris-containing stoppers;

b) a stopper inlet duct having first and second ends, the first end connected to a nozzle for receiving stoppers from the stopper injection hopper;

c) a vertically-positioned, cyclone separator tube having first and second ends, and a stopper receiving duct positioned proximate and adjacent to the first end thereof, the second end of the stopper inlet duct being connected to the stopper receiving duct, the tube being of sufficient diameter for receiving stoppers from the inlet duct, said cyclone separator tube having a plurality of separator fingers positioned proximate and adjacent to the second end thereof;

d) a stopper receiving vessel, positioned beneath and connected to the first end of the cyclone separator, the vessel being of sufficient capacity to receive a plurality of stoppers from the separator tube;

e) an air bleeding valve located on the stopper receiving vessel, positioned below the stopper receiving duct;

f) a vacuum pump having an inlet and outlet for air, a debris collection filter collecting debris, and a vacuum inlet;

g) a vacuum duct having first and second ends, the first end connected to the cyclone separator, and the second end connected to the vacuum inlet of the vacuum pump; and h) means for transferring air through the inlet and outlet of the vacuum pump to create a vacuum within the separator, wherein, debris-containing stoppers in the stopper injection hopper are drawn through the stopper inlet duct into the cyclone separator tube by the vacuum, wherein the debris on the stoppers is separated therefrom and drawn through the vacuum duct into the vacuum filter, and wherein the debris-free stoppers drop through the cyclone separator tube into the stopper receiving vessel.

In yet another embodiment of the invention, there is described a stopper debris separator, characterized by:

a) a stopper injection hopper of suitable volume for receiving a plurality of debris-containing stoppers;

b) a stopper inlet duct having first and second ends, the first end connected to a nozzle for receiving stoppers from the stopper injection hopper;

c) a vertically-positioned, cyclone separator tube having first and second ends, and a stopper receiving duct positioned proximate and adjacent to the first end thereof, the second end of the stopper inlet duct being connected to the stopper receiving duct, the tube being of sufficient diameter for receiving stoppers from the inlet duct, said cyclone separator tube having a plurality of radial projecting, separator fingers positioned proximate and adjacent to the second end thereof;

d) a stopper receiving vessel, positioned beneath and connected to the first end of the cyclone separator, the vessel having a funnel-shaped bottom with an openable door therebeneath, wherein the vessel is of sufficient capacity to receive a plurality of stoppers from the separator tube;

e) an air bleeding valve located on the stopper receiving vessel, positioned below the stopper receiving duct;

f) a stopper collection hopper positioned beneath the stopper receiving vessel door for receiving debris-free stoppers;

g) a vacuum pump having an inlet and outlet for air, a filter for collecting debris, a vacuum inlet, and an openable door being suitable for removal of debris from the filter;

h) a vacuum duct having first and second ends, the first end connected to the cyclone separator, and the second end connected to the vacuum inlet of the vacuum pump; and i) means for transferring air through the inlet and outlet of the vacuum pump to create a vacuum within the separator, wherein, debris-containing stoppers in the stopper injection hopper are drawn through the stopper duct into the cyclone separator tube by vacuum pressure, wherein the debris on the stoppers is separated therefrom and drawn through the vacuum duct into the vacuum filter, wherein the debris-free stoppers drop through the cyclone separator tube into the stopper receiving vessel, and wherein the hopper, nozzle, cyclone separator tube, receiving vessel, air bleeding valve, and vacuum pump are fabricated from stainless steel.

Another embodiment of the present invention is directed to a process for removing unwanted debris from stoppers, using a stopper debris separator, characterized by a stopper injection hopper of suitable volume for receiving a plurality of debris-containing stoppers; a stopper inlet duct having first and second ends, the first end for receiving stoppers from the stopper injection hopper; a vertically-positioned, cyclone separator tube having first and second ends, and a stopper receiving duct positioned proximate and adjacent to the first end of the cyclone separator, the second end of the stopper inlet duct being connected to the stopper receiving duct; a stopper receiving vessel, positioned beneath and connected to the first end of the cyclone separator tube, the vessel being of sufficient capacity to receive a plurality of stoppers from the separator tube; an air bleeding valve located on the stopper receiving vessel; a vacuum pump having an inlet and outlet for air, a filter for collecting debris, and a vacuum inlet; a vacuum duct having first and second ends, the first end connected to the cyclone separator tube, and the second end connected to the vacuum inlet of the vacuum pump; and means for transferring air through the inlet and outlet of the vacuum pump to create a vacuum within the separator, wherein debris-containing stoppers in the stopper injection hopper are drawn through the stopper duct into the cyclone separator tube by the vacuum, wherein the debris on the stoppers is separated therefrom and drawn through the vacuum duct into the vacuum filter, and wherein the debris-free stoppers drop through the cyclone separator tube into the stopper receiving vessel, the process being characterized by the steps of:

a) placing debris-containing stoppers in the stopper injection hopper;

b) contacting the stoppers with the nozzle connected to the stopper inlet duct;

c) transferring air through the inlet and outlet of the vacuum pump to create a vacuum within the separator;

d) vacuuming stoppers from the stopper injection hopper through the inlet duct into the cyclone separator tube, wherein the debris is separated from the stoppers, wherein the debris is vacuumed through the vacuum duct into the vacuum pump filter, and wherein the debris-free stoppers drop into the receiving vessel; and e) opening the door of the receiving vessel and allowing the debris-free stoppers to collect in the stopper collection hopper.

Generally, the stopper debris separator of the present invention may be operated at an instrument air intake pressure of from about 65 to about 95 psi. This air pressure range will generally create a vacuum pressure of from about −3 to about −9 in Hg. The vacuum pressure may be adjusted within the above referenced range to increase or decrease the stopper retention time in the cyclone separator tube so that debris will be vacuumed into the vacuum pump and stoppers will drop into the stopper receiving vessel. The air-bleed valve located on the receiver vessel may be adjusted to regulate the vacuum pressure flowing beneath the stopper inlet duct. The location of the air-bleed valve beneath the stopper inlet duct of the cyclone separator tube provides a second source of vacuum inlet to further clean the stoppers. The second vacuum inlet provides an extra measure of cleaning for the stoppers.

What is claimed is:

1. A stopper debris separator, comprising:

a) a stopper injection hopper of suitable volume for receiving a plurality of debris-containing stoppers;

b) a stopper inlet duct having first and second ends, the first end for receiving stoppers from the stopper injection hopper;

c) a vertically-positioned, cyclone separator tube having first and second ends, and a stopper receiving duct positioned proximate and adjacent to the first end of the cyclone separator, the second end of the stopper inlet duct being connected to the stopper receiving duct, the cyclone separator tube being of sufficient diameter for receiving stoppers from the inlet duct;

d) a stopper receiving vessel, positioned beneath and connected to the first end of the cyclone separator tube, the vessel being of sufficient capacity to receive a plurality of stoppers from the separator tube;

e) an air bleeding valve located on the stopper receiving vessel;

f) a vacuum pump having an inlet and outlet for transferring air, a filter for collecting debris, and a vacuum inlet;

g) a vacuum duct having first and second ends, the first end connected to the second end of the cyclone separator tube, and the second end connected to the vacuum inlet of the vacuum pump; and h) means for transferring air through the inlet and outlet of the vacuum pump to create a vacuum within the separator, wherein, debris-containing stoppers in the stopper injection hopper are drawn through the stopper duct into the cyclone separator tube by the vacuum, wherein the debris on the stoppers is separated therefrom and drawn through the vacuum duct into the vacuum filter, and wherein the debris-free stoppers drop through the cyclone separator tube into the stopper receiving vessel.

2. The separator according to claim 1, wherein a plurality of separator fingers is located within the cyclone separator tube adjacent to the second end thereof.

3. The separator according to claim 2, wherein the air-bleeding valve located on the receiving vessel is positioned below the stopper-receiving duct.

4. The separator according to claim 3, wherein a stopper nozzle is connected to the first end of the stopper inlet duct.

5. The separator according to claim 4, wherein the receiving vessel has vertically opposing first and second ends, the first end being beneath the second end, the first end being funnel-shaped having an openable door, and the second end being connected to the first end of the cyclone separator tube, said door suitable for discharging stoppers from the separator.

6. The separator according to claim 5, wherein the air bleed valve is suitable for adjusting vacuum, inlet pressure in the receiving vessel.

7. The separator according to claim 6, wherein the means for transferring air through the vacuum pump is adjustable to ensure debris and stopper separation.

8. The separator according to claim 7, wherein the inlet duct nozzle has an arched bar across the diameter of the body thereof.

9. The separator according to claim 7, wherein the inlet duct nozzle has an arched, triangular-shaped bar across the diameter thereof.

10. The separator according to claim 7, wherein the inlet duct nozzle has arched, intersecting perpendicular bars across the center thereof, a portion of one bar, adjacent to the body being removed.

11. A stopper debris separator, comprising:

a) a stopper injection hopper of suitable volume for receiving a plurality of debris-containing stoppers;

b) a stopper inlet duct having first and second ends, the first end connected to a nozzle for receiving stoppers from the stopper injection hopper;

c) a vertically-positioned, cyclone separator tube having first and second ends, and a stopper receiving duct positioned proximate and adjacent to the first end thereof, the second end of the stopper inlet duct being connected to the stopper receiving duct, the tube being of sufficient diameter for receiving stoppers from the inlet duct, said cyclone separator tube having a plurality of separator fingers positioned proximate and adjacent to the second end thereof;

d) a stopper receiving vessel, positioned beneath and connected to the first end of the cyclone separator tube, the vessel being of sufficient capacity to receive a plurality of stoppers from the separator tube;

e) an air bleeding valve located on the receiving vessel, positioned below the stopper receiving duct;

f) a vacuum pump having an inlet and outlet for air, a filter for collecting debris, and a vacuum inlet;

g) a vacuum duct having first and second ends, the first end connected to the second end of the cyclone separator tube, and the second end connected to the vacuum inlet of the vacuum pump; and h) means for transferring air through the inlet and outlet of the vacuum pump to create a vacuum within the separator, wherein, debris-containing stoppers in the stopper injection hopper are drawn through the stopper duct into the cyclone separator tube by the vacuum, wherein the debris on the stoppers is separated therefrom and drawn through the vacuum duct into the vacuum filter, and wherein the debris-free stoppers drop through the cyclone separator tube into the stopper receiving vessel.

12. The separator according to claim 11, wherein the receiving vessel has vertically opposing first and second ends, the first end being beneath the second end, the first end being funnel-shaped having an openable door, and the second end being connected to the first end of the cyclone separator tube, said door suitable for discharging stoppers from the separator.

13. The separator according to claim 12, wherein a stopper collection hopper is positioned beneath the openable door of the receiving vessel.

14. The separator according to claim 13, wherein the separator fingers of the cyclone separator tube are radially positioned.

15. The separator according to claim 14, wherein the nozzle connected to the stopper inlet duct has an arched bar across the inlet diameter thereof.

16. The separator according to claim 14, wherein the nozzle connected to the stopper inlet duct has triangular-shaped, arched bars across the inlet diameter thereof.

17. The separator according to claim 14, wherein the nozzle connected to the stopper inlet duct has cross-shaped, arched bars across the inlet diameter thereof.

18. The separator according to any one of claims 15 through 17, wherein the vacuum pump has an air pressure of from about 65 to about 90 psi.

19. The separator according to claim 18, wherein the hopper, nozzle, cyclone separator tube, receiving vessel, air bleeding valve, and vacuum pump are fabricated from stainless steel.

20. The separator according to claim 19, wherein the stopper inlet and vacuum ducts are fabricated from a polymeric material selected from the group consisting of polyvinyl chloride, polyethylene, polypropylene, polyacetals and polybutylenestyrene.

21. A stopper debris separator, comprising:

a) a stopper injection hopper of suitable volume for receiving a plurality of debris-containing stoppers;

b) a stopper inlet duct having first and second ends, the first end connected to a nozzle for receiving stoppers from the stopper injection hopper;

c) a vertically-positioned, cyclone separator tube having first and second ends, and a stopper receiving duct positioned proximate and adjacent to the first end thereof, the second end of the stopper inlet duct being connected to the stopper receiving duct, the tube being of sufficient diameter for receiving stoppers from the inlet duct, said cyclone separator tube having a plurality of radial projecting, separator fingers positioned proximate and adjacent to the second end thereof;

d) a stopper receiving vessel, positioned beneath and connected to the first end of the cyclone separator tube, the vessel having a funnel-shaped bottom with an openable door therebeneath, wherein the vessel is of sufficient capacity to receive a plurality of stoppers from the separator tube;

e) an air bleeding valve located on the receiving vessel, positioned below the stopper receiving duct;

f) a stopper collection hopper positioned beneath the receiving vessel door for receiving debris-free stoppers;

g) a vacuum pump having an inlet and outlet for air, a filter for collecting debris, a vacuum inlet, and an openable door being suitable for removal of debris from the filter;

h) a vacuum duct having first and second ends, the first end connected to the second end of the cyclone separator tube, and the second end connected to the vacuum inlet of the vacuum pump; and i) means for transferring air through the inlet and outlet of the vacuum pump to create a vacuum within the separator, wherein, debris-containing stoppers in the stopper injection hopper are drawn through the stopper duct into the cyclone separator tube by the vacuum, wherein the debris on the stoppers is separated therefrom and drawn through the vacuum duct into the vacuum filter, wherein the debris-free stoppers drop through the cyclone separator tube into the stopper receiving vessel, and wherein the stopper injection hopper, nozzle, cyclone separator tube, receiving vessel, air bleeding valve, and vacuum pump are fabricated from stainless steel.

22. A process for removing unwanted debris from stoppers, using a stopper debris separator, characterized as a stopper injection hopper of suitable volume for receiving a plurality of debris-containing stoppers; a stopper inlet duct having first and second ends, the first end having a nozzle attached thereto being suitable for receiving stoppers from the stopper injection hopper; a vertically-positioned, cyclone separator tube having first and second ends, and a stopper receiving duct positioned proximate and adjacent to the first end of the cyclone separator, the second end of the stopper inlet duct being connected to the stopper receiving duct; a stopper receiving vessel, positioned beneath and connected to the first end of the cyclone separator tube, the vessel being of sufficient capacity to receive a plurality of stoppers from the separator tube; an air bleeding valve located on the receiving vessel; a vacuum pump having an inlet and outlet for air, a filter for collecting debris, and a vacuum inlet; a vacuum duct having first and second ends, the first end connected to the second end of the cyclone separator tube, and the second end connected to the vacuum inlet of the vacuum pump; and means for transferring air through the inlet and outlet of the vacuum pump to create a vacuum within the separator, wherein debris-containing stoppers in the stopper injection hopper are drawn through the stopper duct into the cyclone separator tube by the vacuum, wherein the debris on the stoppers is separated therefrom and drawn through the vacuum duct into the vacuum filter, and wherein the debris-free stoppers drop through the cyclone separator tube into the stopper receiving vessel, the process, comprising the steps of:

a) placing debris-containing stoppers in the stopper injection stopper injection hopper;

b) contacting the stoppers with the nozzle connected to the stopper inlet duct;

c) transferring air through the inlet and outlet of the vacuum pump to create a vacuum within the separator;

d) vacuuming stoppers from the stopper injection hopper through the inlet duct into the cyclone separator tube, wherein the debris is separated from the stoppers, wherein the debris is vacuumed through the vacuum duct into the vacuum pump filter, and wherein the debris-free stoppers drop into the receiving vessel; and e) opening the door of the receiving vessel and allowing the debris-free stoppers to collect in the stopper collection hopper.

* * * * *